US005096399A

United States Patent [19]

Mosemann et al.

[11] Patent Number: 5,096,399

[45] Date of Patent: Mar. 17, 1992

[54] ROTOR PAIR FOR HIGH PRESSURE SCREW COMPRESSOR AND SCREW COMPRESSOR USING SAME

[75] Inventors: Dieter Mosemann; Hans-Ulrich Pews; Andreas Rietzke; Horst Maier; Ottmar Neuwirth; Peter Kolberg, all of Berlin, all of Fed. Rep. of Germany

[73] Assignee: Bauer Kompressoren GmbH, Munich, Fed. Rep. of Germany

[21] Appl. No.: 553,802

[22] Filed: Jul. 18, 1990

[51] Int. Cl.[5] ..... F04C 18/16

[52] U.S. Cl. ..... 418/201.3

[58] Field of Search ..... 418/201.1, 201.2, 201.3

[56] References Cited

U.S. PATENT DOCUMENTS 4,619,596 10/1986 Dammann ..... 418/201.3

4,636,156 1/1987 Hough et al. ..... 418/201.3

FOREIGN PATENT DOCUMENTS 3111834 10/1982 Fed. Rep. of Germany .

88/6247 8/1988 PCT Int'l Appl. .

*Primary Examiner*—Richard A. Bertsch

*Assistant Examiner*—David L. Cavanaugh

*Attorney, Agent, or Firm*—Sixbey, Friedman, Leedom & Ferguson

[57] ABSTRACT

A rotor pair for a high-pressure screw compressor having main and secondary rotors, the main rotor having essentially convex teeth arranged outside its reference circle and the secondary rotor having essentially concave teeth arranged inside its reference circle. The distance between the axes of the rotors, which limits the size of the possible bearings, is enlarged only by increasing the number of teeth and the diameter of the secondary rotor so that it is larger than the main rotor.

7 Claims, 2 Drawing Sheets

ROTOR PAIR FOR HIGH PRESSURE SCREW COMPRESSOR AND SCREW COMPRESSOR USING SAME

FIELD OF THE INVENTION

The invention relates to a rotor pair for a high-pressure screw compressor that consists of a main rotor and a secondary rotor, the main rotor having essentially convex teeth arranged outside its reference circle and the secondary rotor having essentially concave teeth arranged inside its reference circle; wherein both rotors are bolted in opposite directions and the screw angle of the front face of the main rotor relative to the screw angle of the opposite front face of the secondary rotor bears the same relationship as the number of teeth of the main rotor to the number of teeth of the secondary rotor, and the tooth gaps of the main rotor and secondary rotor form communicating V-shaped working chambers in which the operating cycle of suction, compression, expulsion occurs as a result of the rotation of the rotors, so that pressure differences are present at the rotors that lead to action forces on the bearings. The rotors are mounted coaxially in single-thrust bearings and step bearings.

CHARACTERISTICS OF THE KNOWN PRIOR ART

The number of teeth for known rotor pairs for screw compressors is established so that the secondary rotor is rigid enough against bending.

Combinations of numbers of teeth are used with a difference between the number of secondary rotor teeth and main rotor number of teeth equal to $-1$ to $+2$, causing, as a result of the small distance between the axes of the rotors, the load bearing capacity of the single-thrust bearings, especially those of the secondary rotor, to be relatively limited.

In this way, the field of application of known screw compressors is limited to about 2.5 MPa with respect to their maximum allowable operating pressure, and cases of use under high pressure cannot be guarded against.

It is true that increasing the number of teeth on the main and secondary rotor of other known compressors leads to an insignificant improvement of load bearing capacity, but the delivery rate is unfavorably influenced by a worsening of inner sealing since, with an increasing number of teeth on the main rotor with a predetermined conveying stream of the compressor, the tooth gaps that form the V-shaped working chambers are made even smaller than the effective inner gap between the teeth of the main rotor and secondary rotor, and between the rotors and the housing.

SUMMARY OF THE INVENTION

The object of the invention is to enlarge the field of application of screw compressors with respect to higher operating pressures with good energy economic index numbers and low production costs.

This object is obtained, in accordance with the present invention, by changing the main dimensions of the rotors, in increasing the distance between the axes and improving the inner sealing of the screw compressor with respect to the gap volume and with respect to the time required for one cycle. Furthermore, the distance between the axes, which limits the size of the possible bearings, is enlarged only by increasing the number of teeth of the secondary rotor.

DETAILED DESCRIPTION OF THE PREFERRED EMBODIMENT

Figure 1:
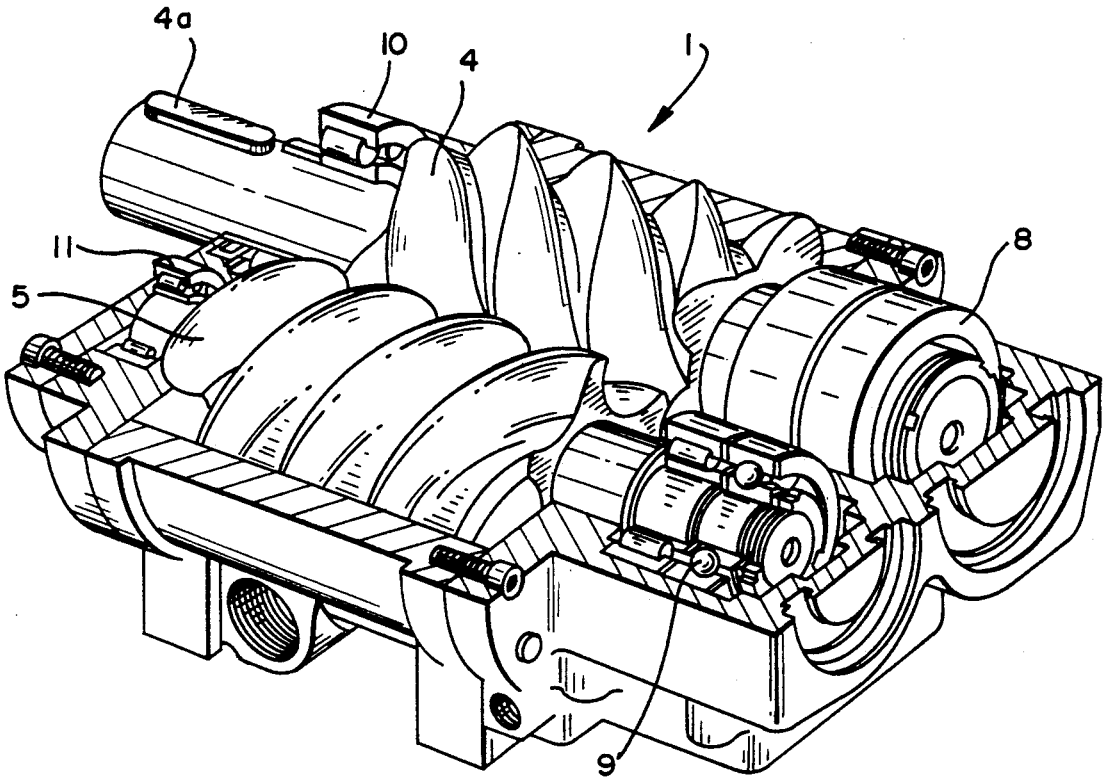
FIG. 1 is a partially broken-away perspective view of a high pressure screw compressor having a rotor pair of the type to which the present invention is directed.

FIG. 1 shows a high-pressure screw compressor 1, with a rotor pair 2 comprising a main rotor 4 with essentially convex teeth arranged outside its reference circle and a secondary rotor 5 with essentially concave teeth arranged inside its reference circle. The rotors 4, 5 are each coaxially mounted, at respective ends of their shafts, in single-thrust bearings 8, 9 and step bearings 10, 11 (by the term step bearing it is meant that the shafts of the rotors are not only radially supported, but are also axially guided in a manner which prevents excessive displacement under the effect of the internal pressure generated during compressor operation). The rotors 4, 5 are spaced at a distance between their axes of rotation, and an electric motor connected to the shaft of rotor 4 at key 4*a* as a means for driving main rotor 4 at a predetermined speed, so that the secondary rotor 5 will be driven by main rotor 4 to work in an opposite direction.

According to the invention, the secondary rotor 5 of the rotor pair 2 of high-pressure screw compressor 3 has at least three teeth more than the main rotor 4. The difference in the number of teeth is a function of the maximum operating pressure and is so large that the increased action force that is connected with the increase in the number of teeth of the secondary rotor 5 and that is on the pressure-side single-thrust bearing 9 of the secondary rotor 5 is smaller than the load-bearing capacity of the largest possible single-thrust bearing which can be accommodated as a result of the distance between the axes of the rotors 4, 5 which, in turn, is determined by the number of teeth on the secondary rotor 5.

This results in a number of teeth on the secondary rotor 5 which will not cause the load-bearing capacity of the single-thrust bearings 8,9 and step bearings 10,11 on the ends of the main and secondary rotors 4, 5 to be exceeded by the action forces produced at the bearing sites and caused by gas force.

With the preferred configuration according to the invention of the number of teeth of the main rotor 4 to that of the secondary rotor 5 is 4 to 8. The screw angle of the secondary rotor 5 is reduced to 50% of the main rotor 4, while the distance between the axes relative to a combination of 4 to 6 teeth increases by 23%. As a result, on the end of the secondary rotor shaft, a ball bearing can be used as a single-thrust bearing with a 40 to 50% higher load-bearing capacity (basis for comparison: bearing outer diameter for the secondary rotor equal to distance between the axes), while the action force at this point at a maximum operating pressure of 3.5 MPa increases only by 8% when the number of teeth of the secondary rotor is increased from 6 to 8. The inner clearances are positively influenced by increasing the number of teeth of the secondary rotor, since bearing clearance and thermal expansion of the rotor work in opposite directions.

Another feature of the invention relates to the size of the screw angle of the main rotor 4, is established as a function of the peripheral speed. In this case, the following ratio exists between screw angle, $P_{HR}$ and peripheral speed, $V_u$:

$$P_{HR}=V_u*K$$

where K = 14 to 18 degrees second per meter and $V_u$ is in meters per second.

By reducing the screw angle, at low peripheral speeds, the inner clearance losses are lowered; especially in small screw compressors, since the course of compression proceeds more rapidly than with the screw angles of 300° to 325° that have been customary up to now. In accordance with the invention, the screw angle of the main rotor 4, measured in degrees, is 14 to 18 times as large as the numerical value of the peripheral speed of the main rotor in meters per second.

An increase in the distance between the rotors 4,5 of a screw compressor, which limits the size of the possible bearings, is achieved by increasing the number of teeth of the secondary rotor. The secondary rotor 5 has at least 3 more teeth than the main rotor 4. By way of example, as shown in FIG. 3, for a maximum operating pressure of 3.5 MPa, the main rotor 1, advantageously, has four teeth and the secondary rotor 3 has eight teeth.

Figure 2:
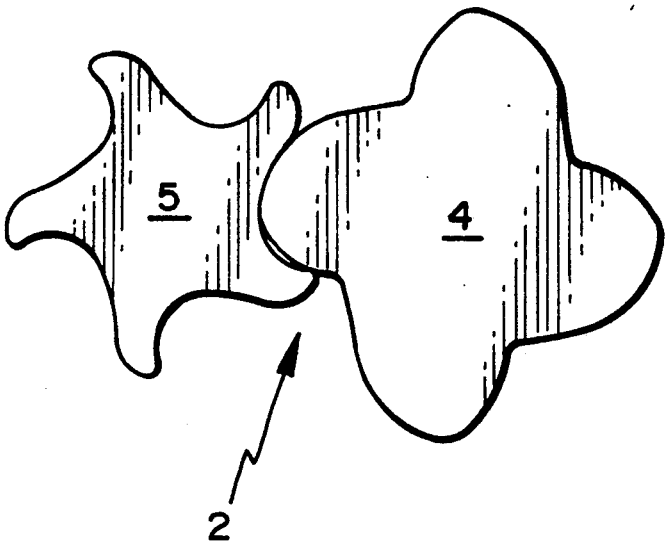
FIG. 2 (PRIOR ART)
FIG. 2 diagrammatically illustrates a conventional rotor pair for use as a point of comparison with a rotor pair in accordance with the present invention.
Figure 3:
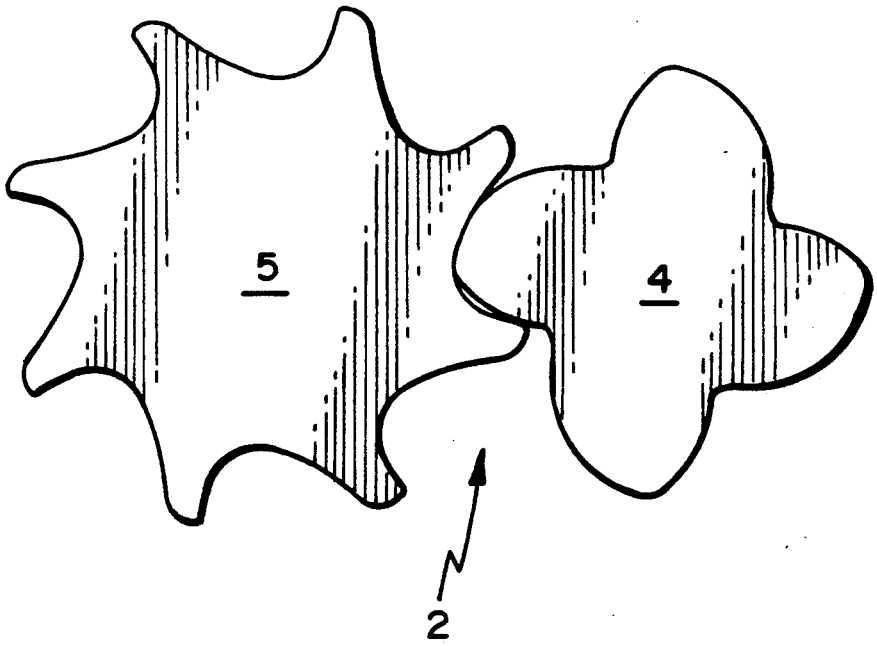
FIG. 3 is a diagrammatic depiction of a rotor pair in accordance with a preferred embodiment of the present invention.

As can be seen by comparing the arrangement of FIG. 3 with the situation where a secondary rotor 5 having only five teeth is matched with the main rotor 4 (FIG. 2), the diameter of the secondary rotor 5 having eight teeth is dramatically larger than that having only five teeth, and unlike that with only five teeth is larger than the main rotor 4. With this 4 to 8 configuration of the number of teeth of the main rotor 4 to that of the secondary rotor 5, the screw angle of the secondary rotor 5 is reduced to 50% of that of the main rotor 4.

It should be appreciated that numerous changes above-described embodiments are possible in accordance with the invention which will be apparent to those of ordinary skill in the art. For example, the specific type and number of bearings serving as the single-thrust and step bearings described above is not, itself, part of the present invention, any known bearing arrangement equivalent to that described may be utilized. Thus, the present invention should not be viewed as limited to the arrangements shown and described herein, and instead, should be considered as encompassing the full scope of the claims appended hereto.

We claim:

1. Rotor pair, for a high-pressure screw compressor, comprising a main rotor with essentially convex teeth arranged outside its reference circle and a secondary rotor with essentially concave teeth arranged inside its reference circle, said rotors being coaxially mounted, in single-thrust bearings and step bearings at a distance from their axes of rotation, to work in opposite directions; wherein, as a means for enabling the load-bearing capacity of the single-thrust bearings of the main and secondary rotor to be larger than the action forces caused by gas force at the bearings due to a work cycle of suction, compression, expulsion pickup in the radial and axial directions, the number of teeth of the secondary rotor is at least 3 more than the number of teeth of the main rotor and the diameter of the second rotor is greater than that of the main rotor.

2. A rotor pair according to claim 1, wherein the diameter of the secondary rotor is over approximately 20% greater than the diameter of the main rotor.

3. Rotor pair according to claim 1, wherein, for a maximum operating pressure of 3.5 MPa, the main rotor has 4 teeth and the secondary rotor has 8 teeth.

4. A high-pressure screw compressor comprising a main rotor with essentially convex teeth arranged outside its reference circle and a secondary rotor with essentially concave teeth arranged inside its reference circle, said rotors being coaxially mounted, in single-thrust bearings and step bearings at a distance from their axes of rotation, to work in opposite directions; wherein, as a means for enabling the load-bearing capacity of the single-thrust bearings of the main and secondary rotor to be larger than the action forces caused by gas force at the bearings due to a work cycle of suction, compression, expulsion pickup in the radial and axial directions, the number of teeth of the secondary rotor is at least 3 more than the number of teeth of the main rotor and the diameter of the second rotor is greater than that of the main rotor.

5. A high-pressure compressor according to claim 4, wherein the diameter of the secondary rotor is over approximately 20% greater than the diameter of the main rotor.

6. Compressor according to claim 4, wherein the compressor has a maximum operating pressure of 3.5 MPa, and wherein the main rotor has 4 teeth and the secondary rotor has 8 teeth.

7. A high-pressure screw compressor according to claim 4, wherein the screw angle of the main rotor, measured in degrees, is 14 to 18 times as large as the numerical value of the peripheral speed of the main rotor in meters per second when said main rotor is being driven at said predetermined speed.

* * * * *